United States Patent [19]

Zacharin

[11] 4,109,455

[45] Aug. 29, 1978

[54] SPIRAL ORIFICE DASHPOT TIMER

[75] Inventor: Alexey T. Zacharin, Parsippany, N.J.

[73] Assignee: The United States of America as represented by the Secretary of the Army, Washington, D.C.

[21] Appl. No.: 800,775

[22] Filed: May 26, 1977

[51] Int. Cl.[2] ..... G04F 13/00

[52] U.S. Cl. ..... 58/1 R; 188/266; 188/322; 102/277

[58] Field of Search ..... 102/82, 83, 75; 58/144, 58/116 R, 48, 1 R; 188/266, 290, 322; 185/37

[56] References Cited

U.S. PATENT DOCUMENTS

| | | | |
|---|---|---|---|
| 2,994,271 | 8/1961 | Silver et al. | 102/82 X |
| 3,171,245 | 3/1965 | Breed | 102/82 X |
| 3,553,959 | 1/1971 | Young et al. | 58/144 |
| 3,563,022 | 2/1971 | Breed | 58/144 X |
| 3,712,421 | 1/1973 | Hadfield | 58/1 R X |
| 3,998,164 | 12/1976 | Hadfield | 102/83 X |

*Primary Examiner*—David H. Brown
*Attorney, Agent, or Firm*—Nathan Edelberg; A. Victor Erkkila; Costa Perchem

[57] ABSTRACT

The present invention relates to a fluid controlled timer comprising a cylindrical housing, and a close-fitting rotary shaft positioned co-axially within the housing. A spiral passageway scribed between the housing and the rotary shaft extends between the ends of the housing. The spiral passageway contains a viscous liquid and a sphere slidably disposed therein and capable of traversing the entire passageway length. An external constant torque spring connected to one end of the rotary shaft causes the rotary shaft movement while resistance to such movement results from interference of the sphere during its traverse through the spiral passageway, thus providing an extended time delay.

3 Claims, 2 Drawing Figures

SPIRAL ORIFICE DASHPOT TIMER

The invention described herein may be manufactured, used and licensed by or for the Government for Governmental purposes without the payment to me of any royalties thereon.

BACKGROUND OF THE INVENTION

The present invention relates generally to timing mechanisms and more particularly to a dashpot type of timer. The dashpot timers usually include a cylindrical tube, in which a piston travels submerged in a fluid and free to move in a directed path. The main body, portion of the piston is made such that its maximum diameter is slightly smaller than the inner diameter of the cylindrical tube to provide clearance for the fluid to pass around the periphery of the piston during the movement of the piston.

These liquid dashpots have limited application as timers, since the fluid flow generated depends on metering and shear of a fluid between the piston and the cylinder wall, thus providing only a short time delay.

To overcome the aforementioned short time delay, it is known to provide a dashpot having a longer tube or a more viscous fluid. Such known variations have not fulfilled the need for a simply constructed, inexpensively fabricated, easily installed and fully service-dependable dashpot.

The present invention eliminates the shortcomings of the prior art by providing a device which is simple in construction and certain and dependable in operation.

SUMMARY OF THE PRESENT INVENTION

The subject invention relates to a dashpot timer containing a sphere traveling in a spiral passageway at a controlled rate of speed. This movement occurs due to a predictable fluid flow from the front to the rear of the sphere controlled by a spring which guides the sphere to the desired speed.

It is the object of this invention to provide a substantially greater time delay period than provided by the prior art.

Another object of this invention is to provide for an exceptionally reliable timer.

Still another object of this invention is to provide a timer whose mechanical motion is rotational rather than linear.

An additional object of this invention is to provide the capability to extend time delay in a rotary shaft at a minimum angle of rotation.

Another object of this invention is to provide a timer whose timing cycle is independent of the forces of gravity.

The invention accordingly comprises the dashpot device possessing the features, properties, and relation of elements which will be exemplified in the device hereinafter described and the scope of the invention will be indicated in the claims.

BRIEF DESCRIPTION OF THE DRAWINGS

The invention and a fuller understanding of its nature and objects will appear more clearly from the following detailed description taken in conjunction with the accompanying drawings, showing by way of example a preferred embodiment of the inventive concept and in which.

Throughout the following description like reference numerals are used to denote like parts in the drawings.

DESCRIPTION OF THE PREFERRED EMBODIMENTS

Figure 1:
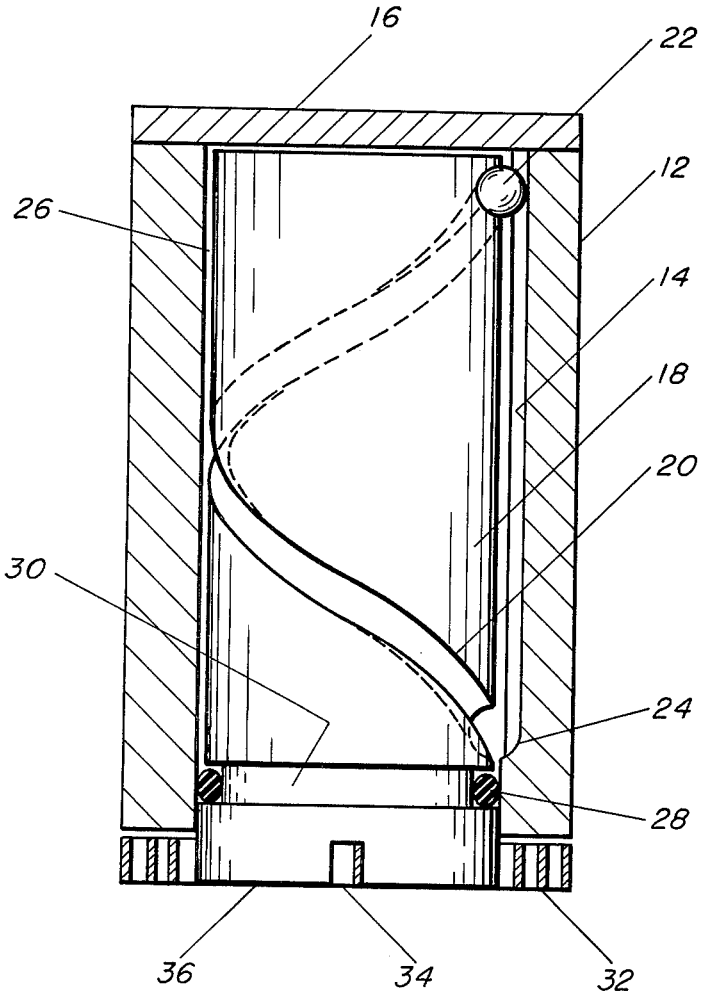
FIG. 1 is a longitudinal cross sectional view of the spiral dashpot made in accordance with the principles of the present invention.

The present invention is concerned with extending the delay time of dashpots and more particularly a dashpot which is adapted for use in fuzes. The dashpot can be employed on all sizes of fuzes since it would not be a larger unit than is presently used and in fact would be smaller. The dashpot depicted in the drawings and be described hereinafter is designed primarily for military use, it being understood however that such described use is given by way of illustration and not limitation.

Referring now to FIG. 1 the dashpot 10 is of known type of external construction and is provided with a cylindrical tubular housing 12 of elongated configuration having a semi-circular groove 14 on the inside diameter and parallel to the axis. A cover 16 is attached to the top of the housing 12 in order to seal the upper end of the housing 12.

Figure 2:
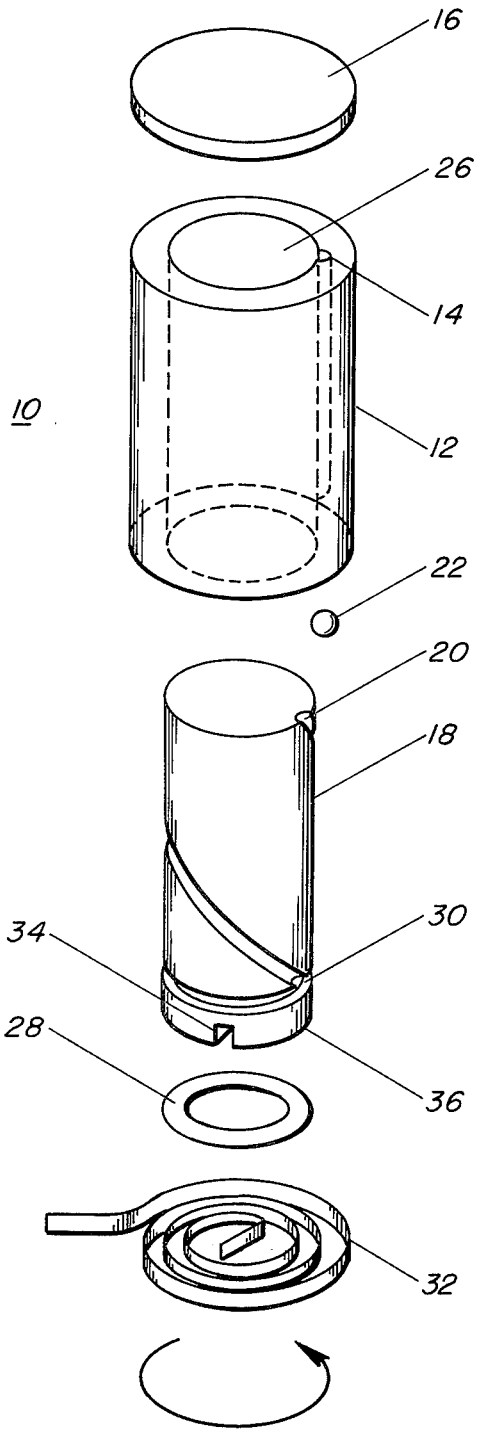
FIG. 2 is an exploded view of the spiral dashpot on an enlarged scale showing the parts disassembled.

A cylindrical shaft 18, positioned within the tubular housing 12, contains a semi-circular groove 20, which extends spirally from the top to the bottom of the face of shaft 18. The semi-circular grooves 14 and 20 are matched at the upper ends to form a circular groove and a ball bearing 22 is placed in the circular groove 24 thus formed, as shown in FIG. 2. The space or clearance formed between the ball bearing 22 and the circular groove 24 resulting from the combination of semi-circular grooves 14 and 20 is referred to as the orifice. The entire cavity formed between the shaft 18 and housing 12 is filled with a suitable viscous liquid 26. An O ring 28 is inserted in the O ring groove 30 on the shaft 18, thereby sealing the cavity. A spring 32 fixedly attached to housing 12 is used to rotate the shaft 18 through a spline 34 and the shaft at output 36 is attached to a component to be timed (not shown).

The spiral dashpot operates as follows:

The release of the shaft 18 starts the timing sequence powered by the spring 32. As the shaft rotates, the spiral portion, of the semi-circular groove 20 located on the shaft 18 will force the ball bearing 22 against the wall of semi-circular groove 14, located in the housing 12. This action will move the ball bearing downward along the semi-circular groove 14 of the housing. As the ball bearing moves it will force the viscous fluid to flow through the orifice formed between the ball bearing 22 and the circular raceway 24. This fluid flow will provide the desired delaying action to the shaft rotation, thus providing a timing action.

It will be understood that the dashpot of the present invention can be subject to certain modifications or changes within the scope of the invention. For example, various time delays may be obtained by a combination of viscous fluids. Also, the number of ball bearings can be varied and the angle of the shaft rotation e.g., spiral groove can be changed. Furthermore, more than one ball bearing/groove combination would be used to provide a longer delay sequence.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

I claim:

1. A dashpot timer comprising;

a cylindrical housing;

a close-fitting, concentric shaft positioned within said housing and rotatable relative thereto;

a spiral, semi-circular groove on the shaft exterior and a semi-circular groove on the housing interior, thereby forming a circular raceway and communicating with both ends of said shaft and said housing;

a sphere movably positioned in said raceway;

a viscous fluid filling the space between the shaft and the housing;

means for rotating the shaft relative to said housing; whereby movement of the sphere in said raceway produced by rotation of the shaft relative to the housing forces the viscous fluid to flow through the orifice formed between the sphere and said raceway, thereby delaying said rotation and providing a timing action.

2. A dashpot timer as claimed in claim 1 wherein the shaft rotating means is a spring.

3. A dashpot timer as claimed in claim 2 wherein an output means connection is formed on said shaft.

* * * * *